US005732859A

United States Patent [19]

LeBlanc

[11] Patent Number: 5,732,859

[45] Date of Patent: Mar. 31, 1998

[54] APPARATUS FOR PRESSING GARMENTS

[76] Inventor: Kevin A. LeBlanc, 3431 W. Pinhook Rd., Lafayette, La. 70508

[21] Appl. No.: 619,971

[22] Filed: Mar. 20, 1996

[51] Int. Cl.[6] ..... A41H 5/02; A41H 5/00

[52] U.S. Cl. ..... 223/67; 223/66; 223/70; 223/68

[58] Field of Search ..... 223/67, 66, 68, 223/70, 73

[56] References Cited

U.S. PATENT DOCUMENTS

| | | | |
|---|---|---|---|
| 3,262,615 | 7/1966 | Killey | 223/67 |
| 3,480,187 | 11/1969 | Bonn | 223/67 |
| 5,148,955 | 9/1992 | Cares | 223/67 |
| 5,458,265 | 10/1995 | Hester et al. | 223/67 |

FOREIGN PATENT DOCUMENTS

| | | | |
|---|---|---|---|
| 1635167 | 12/1979 | Germany | 223/67 |

OTHER PUBLICATIONS

European Patent Application, EPO 096 080, Dec. 1983 Ochia:.

*Primary Examiner*—Bibhu Mohanty
*Attorney, Agent, or Firm*—Keaty & Keaty

[57] ABSTRACT

The invention relates to a garment pressing machine for ironing shirts, blouses and similar articles of clothing. The machine is provided with a dressing station, a pressing station, and a mannequin movable between the dressing station and the pressing station. The mannequin has an inflatable body which is inflated while the mannequin is still at the dressing station to allow an operator to remove creases from a garment draped over the mannequin before the mannequin is moved into the pressing station, where the garment is contacted by heated pressing plates to facilitate ironing of the garment.

16 Claims, 2 Drawing Sheets

APPARATUS FOR PRESSING GARMENTS

BACKGROUND OF THE INVENTION

This invention relates to a machine for pressing garments, and, more particularly, to an apparatus for pressing, or ironing shirts, blouses and similar articles of clothing.

Shirt pressing machines are known in the industry and generally comprise a shirt supporting body, or buck, which is movable on a track between a dressing station and a pressing station, where the front and back of the shirt is contacted by heated pressing plates for the purpose of removing wrinkles and, at the same time, drying the shirt.

Typically, at the pressing station, compressed air is admitted into the interior of the buck and exits through a plurality of openings formed in the inflatable buck body, so as to facilitate drying and pressing of the garment. Various drawbacks are associated with this type of operation. One of the drawbacks is inability of an operator to smooth out any creases, or wrinkles which may be present in a wet shirt draped around the buck after it has left the dressing station. The creases are present due to either incorrect draping of the shirt or due to movement of the mannequin on the rail between the dressing station and the pressing station.

As a result, it becomes very difficult to achieve a wrinkle-free ironing of the garment, and an operator often has to manually iron the front and back of the just pressed shirt in order the remove the small pressed-in wrinkles. This secondary ironing results in the loss of time and is very labor intensive. This drawback becomes particularly pronounceable if an operator is inexperienced, and the shirt was not positioned properly on the mannequin at the dressing station. In such a case, the problem of smoothing out the ironed-in wrinkles become even more cumbersome and time consuming.

Various methods have been suggested to solve the problem of garment draping in such a manner as to minimize the problem of faulty ironing. One of the solutions calls for the provision of sleeve extenders to move the sleeves of the shirt laterally outwardly in response to an actuation of air cylinders. When a shirt is positioned on a buck, the sleeve extenders pull on the sleeves to remove the wrinkles from the sleeves as the arms of the piston cylinders are moved to an expanded position. Such a design is shown in, for example, U.S. Pat. No. 3,471,067.

Another design of a shirt pressing machine is shown in U.S. Pat. No. 3,595,450, wherein the buck is provided with inflatable side bags and yoke. Still another design is shown in U.S. Pat. No. 3,480,187, where the yoke bag is provided with a coil spring which prevents collapse of the yoke bag while the buck is being dressed. The compressible spring forces the bag to expand and provide a wrinkle-free draping of the yoke of the shirt on the mannequin.

While such improvements assist in proper draping of the shirt, or a similar garment, on the mannequin at the dressing station, there still exists the problem of the mannequin being inflated to a degree not sufficient to fill a large size shirt or of the wet garment twisting about the mannequin body, as a result of which a smooth, wrinkle-free dressing of the mannequin remains difficult to achieve.

The present invention contemplates elimination of the drawbacks associated with the prior art and provision of an apparatus and method for pressing garments that substantially minimizes or entirely eliminates the problem of wrinkles in a garment on a dressed mannequin before the mannequin is moved to a pressing station.

SUMMARY OF THE INVENTION

It is, therefore, an object of the present invention to provide an apparatus and method of pressing garments that allows to eliminate or substantially minimize undesirable ironed-in wrinkles.

It is another object of the present invention to provide an improved apparatus for pressing shirts that can be incorporated into currently existing shirt pressing machines without extensive modifications or expense.

It is a further object of the present invention to provide a method of pressing a garment conducted with the use of an inflatable mannequin.

These and other objects of the invention are achieved through a provision of an apparatus for pressing garments which comprises a dressing station and a pressing station. A buck, or mannequin is adapted for movement between the dressing station and the pressing station. The buck has an inflatable body and allows admission of air into the interior of the normally flat inflatable body to expand it to such a degree as to more closely conform to the shape of a human body. The apparatus provides for the use of a flow control device which regulates admission of air into the inflatable body while the buck is at the dressing station. In this manner, an operator can ensure proper draping and crease-free arrangement of a still wet garment, such as a shirt or a blouse, over the mannequin body. When the inflatable body is expanded at the dressing station, most of the creases or wrinkles are removed, thereby ensuring a better finished product of the pressing operation. The inflated buck is moved into the pressing station, wherein the garment is contacted by two opposing heated plates, while hot air is admitted into the inflatable body through the flow control device, so as to simultaneously dry the garment.

The flow control device is mounted between a source of pressurized gas, such as air, and the mannequin body. The flow control device has a housing with an inlet opening and at least one gas outlet opening through which the pressurized gas is transmitted to the inflatable body. A second outlet in the housing of the flow control device is connected by a fluid conduit to a heating unit, from which the heated air is transmitted to the interior of the inflated mannequin body, while the mannequin is at the pressing station.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
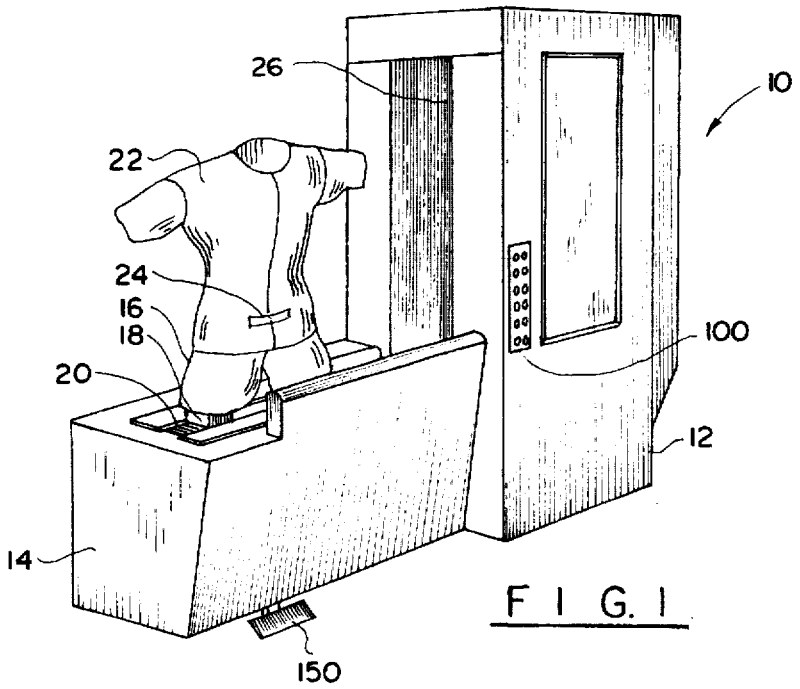
FIG. 1 is a schematic perspective view of an apparatus in accordance with the present invention.

Turning now to the drawings in more detail, numeral 10 designates the apparatus in accordance with the present invention. The pressing machine 10 comprises a pressing cabinet 12 which houses a pressing station, and a dressing station 14. A mannequin, or buck 16 is secured on a pedestal, or table 18 which, in turn, is adapted for movement along a rail 20 between the dressing station 14 and a pressing station inside the cabinet 12.

Conventionally, an operator drapes a shirt 22, or a similar garment, while it is still wet, on the buck 16 and straightens out the tail of the shirt which is then secured by a tail clamp 24, so as to retain the shirt in a generally straight position on the buck 16. If desired, the buck 16 can also be provided with a collar clamp assembly (not shown) which secures the top end of the garment or a collar of a shirt to the front of the buck. An operator then attempts to smooth out any wrinkles in the shirt 22, after which step the machine is operated to move the buck 16 into the pressing cabinet 12 through a side access door 26 formed in alignment with the rail 20.

When using a conventional machine, an operator will then press a corresponding button on the control box of the pressing cabinet to allow compressed air to enter the interior of the inflatable mannequin body and expand the buck body to remove the creases in the garment being pressed. In the pressing cabinet 12, steam heated heads, or heated plates move towards the front and back of the shirt 22, ironing the shirt, while heated pressurized air is forced into the inflatable buck to exit through the openings formed in the inflatable body so as to dry and finish the sides and the yoke of the garment.

The present invention, in contrast, allows an operator to inflate the buck 16 while it is still at the dressing station 14 to a degree sufficient to cause straightening out and smoothing of all wrinkles in the garment 22 draped over the buck 16. In this manner, when the buck 16 is moved into the pressing cabinet 12, the possibility of the wet garment 22 changing its position or twisting on the buck 16 is minimized or even entirely eliminated. The shirt, or garment 22 is pressed, in a conventional manner, in the pressing cabinet 12, while the buck 16 remains inflated and heated air is forced into the buck 16. Once the shirt is removed from the buck 16, the buck is allowed to deflate while the next garment is draped over it.

Figure 2:
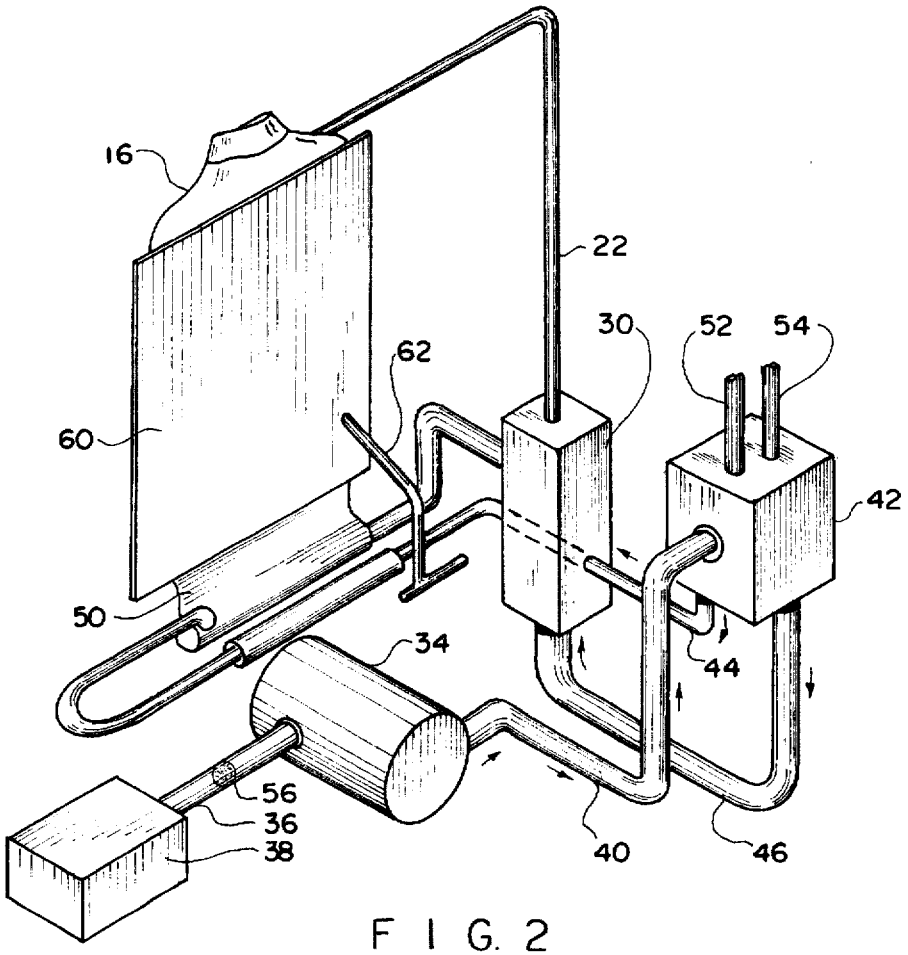
FIG. 2 is a schematic view illustrating a heating and air circuit of the apparatus in accordance with the present invention, with some of the tubing not shown for clarity.

Turning now to FIG. 2, the heating and air pressure circuit of the apparatus in accordance with the present invention is shown to comprise a heat exchanger 30 connected by air conduit 32 with a top and bottom of the buck 16. An air blower 34 is positioned downstream from the heat exchanger 30 and is connected by suitable conduit 36 to an air filter 38. A butterfly valve 56 is mounted in the conduit 36 to control the air flow from the air filter 38 and to the blower 34. The outlet of the blower 34 is connected by suitable hose, or conduit 40 to a flow control device 42 which has a number of other conduits connected thereto.

Mounted in a fluid receiving relationship with the flow control device 42 are a pair of conduits 44 and 46. The hose 44 transmits air from the flow control device 42 to a lower part 50 of the buck 16 to allow inflation of the buck body while the buck 16 is at the dressing station 14. The conduit 46 connects the flow control device 42 with the heat exchanger 30 to transmit pressurized air to the top of the buck 16, when the buck is at the pressing station. A pair of two-way air cylinders 52 and 54 are connected to an upper part of the housing of the flow control device 42 and move, in a reciprocating fashion, within the housing 42, as will be described hereinafter.

A pressing plate, or head 60 is heated by air which passes through the heat exchanger 30 and is delivered to the pressing plate 60 through suitable conduits (not shown for clarity). The steam from the pressing operation is collected and returned through a specially provided conduit 62 (schematically shown in FIG. 2) into the heat exchanger for subsequent recirculation. The heat exchanger conventionally contains a steam heated coil for heating of the air supplied to the expandable buck body 16. The heated air from the heat exchanger is delivered into the buck 16 when the mannequin is at the pressing station, that is before the plates 60 close, so as to gently smooth out any wrinkles in the shirt and dry the shirt at the same time.

Figure 4:
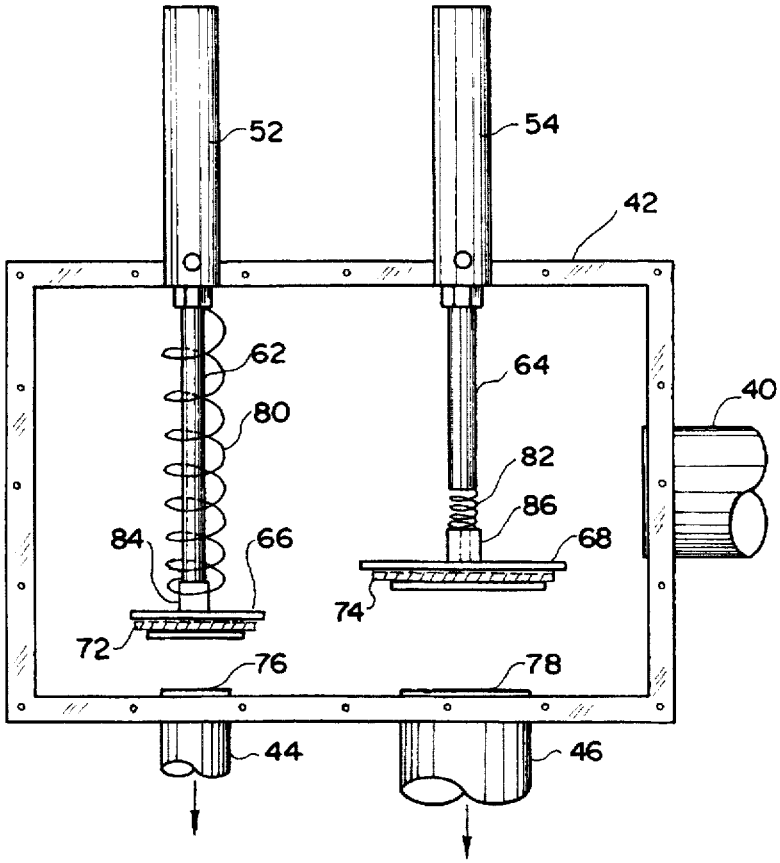
FIG. 4 is a schematic view illustrating air flow control device of the apparatus in accordance with the present invention.

Turning now to FIG. 4, the flow control device 42 is shown in more detail. The flow control device 42 comprises a hollow housing which houses a pair of cylindrical rods, or pistons 62 and 64 connected to air cylinders 52 and 54, respectively. The rods 62 and 64 are provided with transverse plates 66 and 68, each of which carries a flexible, resilient diaphragm designated by numerals 72 and 74, respectively. The rods 62 and 64 move within the housing, forcing the diaphragms 72 and 74 into a closing contact with the openings 76 and 78 which communicate with the conduits 44 and 46.

If desired, a compression coil spring 80 can be mounted in a surrounding relationship about the rod 62, and a similar coil spring 82 can be mounted in circumferential relationship about the rod 64. The springs 80 and 82 are mounted for compression between the air cylinders 52, 54 and the contact members 84, 86 secured to the top surface of the plates 66 and 68.

Figure 3:
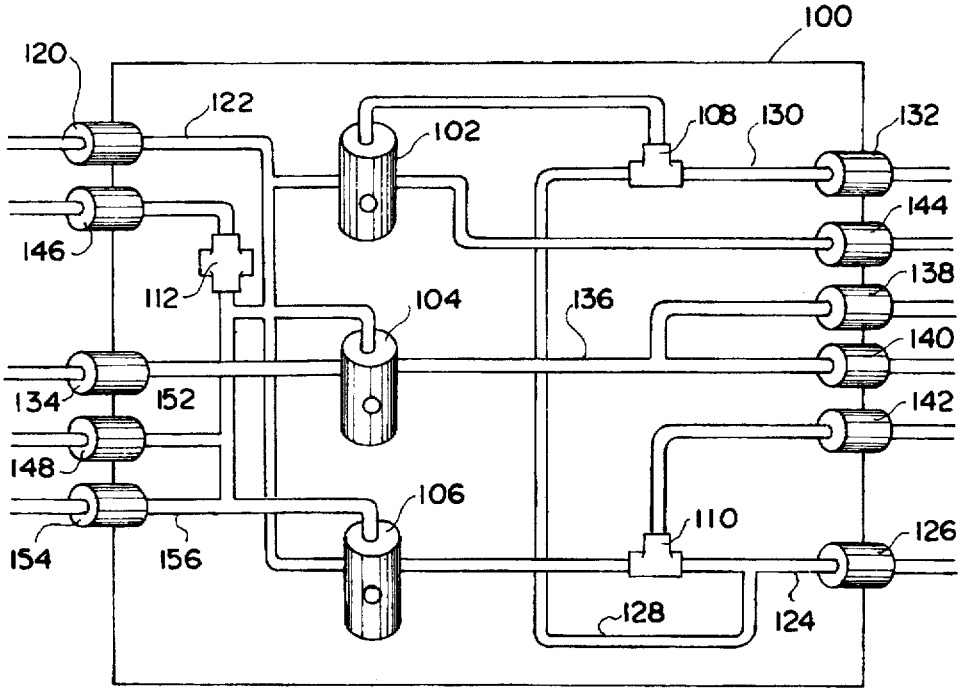
FIG. 3 is a schematic view of a main control box of the apparatus in accordance with the present invention illustrating connection of the air conduits to the control means.

The movement of the air cylinders 52 and 54, as well as the operation of the entire apparatus is accomplished through regulation of controls of the main control device 100 mounted on the front of the pressing cabinet 12 and schematically illustrated in FIG. 3. As can be seen in the drawing, the main control device comprises three-way control valves 102, 104 and 106. The valves 102 and 106 are connected to shuttle valves 108 and 110, respectively, while the control valve 104 is connected, through suitable conduits, to a one-way check valve 112.

A number of control knobs, or buttons are connected by suitable conduits to the control valves 102, 104, and 106, as well as to the shuttle valves 108, 110 and the check valve 112. An air supply control button 120 is connected through a conduit 122 to the shuttle valve 110 and, through suitable tubing 124, to a control button 126 leading to an existing initial air cylinder.

Extending between the shuttle valve 110 and the control knob 126 is a conduit 128 which leads to the shuttle valve 108 and, by connector conduit 130, to a regulator 132, which is operationally connected to an existing butterfly valve 56. The button 132 controls opening of cylinder for initial pre-inflation of the buck 16. Closing of the cylinder is accomplished by pressing a control button 134 which is connected to the butterfly valve 56 and, by a three-way control valve 104, through connector conduit 136 to a high pressure air cylinder regulator 138. Butterfly valve regulator 140 causes closing of the existing butterfly valve. A regulator 142 controls excessive air to the initial air cylinder by connecting the control to the shuttle valve 110 and to the main air supply regulator 120. The high air pressure cylinder regulator 144 allows opening of the cylinder and introduction of pressurized air from the heat exchanger 30.

The main control device 100 is also provided with a control button 146 which regulates operation of a foot pedal 150 (see FIG. 1) mounted in the lower part of the dressing station 14. A table release button 148 is operationally connected, by suitable connector conduit 152, to the foot pedal regulator 146 through the check valve 112. Similarly, a pressing plate release valve control 54 is connected by suitable conduit 156 to the foot pedal button 146 and to the control valve 106.

The foot pedal 150 is designed to operate the tail clamp 24 and secure the bottom part of the garment, closing the gap between opened front portions of a shirt or a blouse.

In operation, the user drapes a still wet garment that requires pressing on the buck 16, while the buck 16 is at the dressing station 14. The foot pedal 150 is operated to clamp the tail clamp 24 and, if desired, a collar clamp is moved into engagement with the collar area of the shirt 22. The operator then admits air, by pressing corresponding control button 120 into the air filter and to the blower 34 through the butterfly valve 56. By depressing the button 132, the operator allows a small amount of air to travel from the flow control device into the inflatable buck body 16 and cause expansion of the inflatable bag which forms the body of the mannequin 16. The table, or pedestal 18, on which the buck 16 rests is then moved by operating the table release button 148, allowing the mannequin to be moved into the pressing station 12. The ironing of the garment 22 is then conducted in a conventional manner, by moving the pressing plates 60 towards each other, into contact with the front and back of the garment 22. Once the ironing is completed, the buck 16 is returned to the dressing station 14, where the finished garment 22 is removed from the mannequin 16 and a new garment is draped over the mannequin. By operating the buttons on the main control device 100, an operator can control every stage of the operation, opening and closing the air conduits leading to the pressing plates, the mannequin, and driving the air cylinders that control movement of elements within the apparatus 10.

Many changes and modifications can be made in the design of the present invention without departing from the spirit thereof. I, therefore, pray that my rights to the present invention be limited only by the scope of the appended claims.

I claim:

1. An apparatus for pressing garments, comprising:

a dressing station having a buck provided with an inflatable body;

a pressing station having at least one heated plate for contacting a garment draped over said inflatable body;

a means for station and said preseen said dressing station and said pressing station; and a means for admitting non-heated air into a lower part of said inflatable body for inflating said inflatable body while said buck is at the dressing station, so as to facilitate draping of a garment over said inflatable body in a substantially wrinkle-free manner.

2. The apparatus of claim 1, wherein said means for inflating comprises a flow control device mounted in fluid communication between a source of air and said inflatable body.

3. The apparatus of claim 2, wherein said flow control device comprises a housing, a pair of pistons movable within said housing in response to control signals received from exterior of said housing, each of said pistons carrying a flexible resilient diaphragm for selectively closing a corresponding air outlet opening formed in said housing.

4. The apparatus of claim 2, wherein said flow control device comprises a housing provided with at least one air inlet opening and at least one air outlet opening, at least one piston movable within said housing, and a flexible resilient closing member carried by said at least one piston for selectively closing said at least one air outlet opening in response to a signal received from an exterior of said housing.

5. The apparatus of claim 4, wherein said housing is provided with a pair of outlet openings, one of said outlet openings being connected to said inflatable body, another of said outlet openings being connected to a means for heating incoming air, said heating means supplying heated air to the interior of said inflatable body when the buck is positioned at the pressing station.

6. An apparatus for pressing garments, comprising:

a dressing station having a mannequin with an inflatable body;

a pressing station having at least one heated plate for contacting a garment draped over said inflatable body;

a means for moving said mannequin between said dressing station and said pressing station; and a means for inflating said inflatable body while the mannequin is at the dressing station, so as to facilitate removal of creases in a garment draped over said inflatable body, said means for inflating comprising a flow control device mounted in fluid communication between a source of pressurized air and an interior lower part of said inflatable body for admitting non-heated air into said inflatable body while the mannequin is at the dressing station.

7. The device of claim 6, wherein said flow control device comprises a housing provided with at least one air inlet opening and at least one air outlet opening, at least one piston movable within said housing in response to a control signal received from an exterior of said housing, said piston carrying a flexible resilient member for selectively closing said at least one air outlet opening, so as to terminate input of air into said inflatable body.

8. The apparatus of claim 6, wherein said flow control device comprises a housing having an inlet opening in fluid communication with a source of pressurized air, and a pair of outlet openings, one of said outlet openings being in fluid communication with an interior of said inflatable body, and another of said outlet openings being in fluid communication with a means for heating incoming air, said heating means supplying heated air to the interior of said inflatable body when the mannequin is positioned at the pressing station.

9. The apparatus of claim 8, wherein said flow control device further comprises a pair of pistons reciprocally moving within said housing for selectively opening said air outlet openings and allowing pressurized air to exit from said housing.

10. A method of pressing garments, comprising the steps of:

providing a dressing station having a mannequin suitable for receiving a garment thereon, said mannequin comprising an inflatable body;

providing a pressing station having at least one heated plate for contacting the garment draped over the mannequin;

draping a garment over said inflatable body;

admitting non-heated pressurized gas into a lower part of said inflatable body, thereby causing said inflatable body to expand, while removing creases from said garment;

moving said mannequin into said pressing station;

admitting heated air into an upper part of said inflatable body; and contacting said garment with said at least one heated plate to thereby iron the garment draped over the mannequin.

11. The method of claim 10, further comprising a step of controlling a gas flow to said mannequin.

12. The method of claim 11, wherein said step of controlling the gas flow comprises a step of providing a flow control device mounted between a source of pressurized gas and said mannequin.

13. The method of claim 12, wherein said flow control device comprises a housing having an opening for admitting pressurized gas into the housing, and a pair of gas outlet openings for allowing pressurized gas to exit the housing, said openings being selectively opened in response to a signal received from an exterior of said housing.

14. The method of claim 13, wherein said flow control device further comprises a pair of pistons reciprocally moving within said housing towards and away from said gas outlet openings.

15. The method of claim 14, wherein each of said reciprocating pistons carries a flexible resilient member for selectively closing a corresponding gas outlet opening.

16. The method of claim 13, wherein one of said gas outlet openings is fluidly connected with an interior of said inflatable body for supplying gas to said inflatable body while the mannequin is at the dressing station, and said second gas outlet opening being fluidly connected to a means for heating gas, said means for heating gas being in fluid communication with an interior of said inflatable body for supplying heated gas t0 said inflatable body while the mannequin is at the pressing station.

* * * * *

UNITED STATES PATENT AND TRADEMARK OFFICE

CERTIFICATE OF CORRECTION

PATENT NO. : 5,732,859
DATED : March 31, 1998
INVENTOR(S) : Kevin A. LeBlanc

It is certified that error appears in the above-identified patent and that said Letters Patent is hereby corrected as shown below:

Claim 1,
Lines 6-7, change "a means for station and said preseen said dressing station and said pressing station; and"

to

-- a means for moving said buck between said dressing station and said pressing station; and --.

Signed and Sealed this

Twenty-sixth Day of February, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,732,859
DATED : May 31, 1998
INVENTOR(S) : Kevin A. LeBlanc

It is certified that error appears in the above-identified patent and that said Letters Patent is hereby corrected as shown below:

Claim 1,
Lines 6-7, change "a means for station and said preseen said dressing station and said pressing station; and"

to

-- a means for moving said buck between said dressing station and said pressing station; and --.

Signed and Sealed this

Fifth Day of March, 2002

*Attest:*

*Attesting Officer*

JAMES E. ROGAN
*Director of the United States Patent and Trademark Office*